US005307791A

United States Patent [19]

Senoue et al.

[11] Patent Number: 5,307,791

[45] Date of Patent: May 3, 1994

[54] AIR MASSAGING DEVICE WITH A PRECISE PRESSURE CONTROL

[75] Inventors: Masaharu Senoue, Yokkaichi; Haruhiko Naruse, Hikone, both of Japan

[73] Assignee: Matsushita Electric Works, Ltd., Osaka, Japan

[21] Appl. No.: 890,828

[22] Filed: Jun. 1, 1992

[30] Foreign Application Priority Data

May 30, 1991 [JP] Japan ..... 3-127424
Aug. 27, 1991 [JP] Japan ..... 3-214067

[51] Int. Cl.[5] ..... A61H 1/00

[52] U.S. Cl. ..... 601/9; 128/DIG. 20; 601/11

[58] Field of Search ..... 128/24 R, 64, 202.11, 128/DIG. 20; 606/202

[56] References Cited

U.S. PATENT DOCUMENTS

| | | | |
|---|---|---|---|
| 3,811,431 | 5/1974 | Apstein | 128/64 |
| 3,885,554 | 5/1975 | Rockwell, Jr. | 128/64 |
| 3,892,229 | 7/1975 | Taylor et al. | 128/64 |
| 4,106,002 | 8/1978 | Hogue, Jr. | 606/202 |
| 4,186,732 | 2/1980 | Christoffel | 128/24 R |
| 4,294,261 | 10/1981 | Baker et al. | 606/202 |
| 4,702,232 | 10/1987 | Gardner et al. | 128/64 |

*Primary Examiner*—Richard J. Apley
*Assistant Examiner*—Jeanne M. Mollo
*Attorney, Agent, or Firm*—Armstrong, Westerman, Hattori, McLeland & Naughton

[57] ABSTRACT

An air massaging device having at least one inflatable air bag adapted to be laid against a portion of the human body. The device includes an air pump generating a pressurized air and a distributor valve which has an open position of feeding the pressurized air to the air bag and a closed position of allowing the pressurized air to be discharged from the air bag to the atmosphere in order to repeat inflating and deflating the air bag. A single pressure sensor is disposed upstream of the distributor valve to monitor a pressure level developed on the side of the air pump. A control circuit is included to activate the air pump on a time-period basis in order to give a desired pressure level to which the air bag is inflated. The control circuit operates to provide one or more initial inflation cycle and subsequent inflation cycles alternated by deflating cycles. During the initial inflating cycle, the air pump is activated for a pre-determined standard inflation time period to inflate the air bag and then stops while keeping the air bag inflated for a short time interval in which the pressure level of the air bag is monitored. In the subsequent inflating cycles, the air pump is activated for a varying inflation time period which is a function of the previous inflation time period, a desired target pressure level selected by a user, and the pressure level monitored in the previous inflation cycle.

27 Claims, 6 Drawing Sheets

AIR MASSAGING DEVICE WITH A PRECISE PRESSURE CONTROL

BACKGROUND OF THE INVENTION

1. Field of the Invention

The present invention relates to an air massaging device with a precise pressure control.

2. Description of the Prior Art

An air massage device ordinarily has at least one inflatable air bag to massage each arm or leg of the human body. Each air bag is wrapped around as shown in FIGS. 1 and 2, is inflated by pressurized air provided from an air pump, and then is deflated by discharging the pressurized air to the atmosphere. Therefore, each arm or leg is massaged by alternating an inflating time period and a deflating time period of the air bag. It is preferable that each of the air bags has a pressure sensor to monitor a pressure level of the respective air bag. However, as a pressure sensor for every air bag is required for an air massage device having a plurality of the air bags, such an air massage device creates difficulties because of necessary complex circuits and its expensive cost. This was a first problem in the prior art.

If a pressure level of each air bag is able to be monitored by a single pressure sensor, i.e., the pressure sensor arranged on the side close to the air pump, not in the air bag, this first problem of the prior art can be improved. However, a second problem will then occur. That is, a difference between a practical pressure level of the air bag and a pressure level monitored by the sensor is caused by a flow resistance of a hose tube connecting between the air pump and the air bag. The flow resistance increases as a bore of the hose tube is smaller and as an exhaust capability of the air pump is higher.

It was proposed that the monitored pressure level is corrected by defining a correlation of the monitored pressure level to the practical pressure level of the air bag, so that the second problem will be improved. However, the corrected value is influenced by different sizes of arms or legs of the human bodies wrapped by the air bag.

It was also proposed that the pressurized air provided from the air pump is fed to the air bag for a predetermined time period. However, once again, the monitored pressure level is changed by different sizes of the arms or legs. That is, when a thick arm or leg is massaged, the monitored pressure level is higher; on the other hand, when a thin arm or leg is massaged, the monitored pressure level is lower.

SUMMARY OF THE INVENTION

The above problems and insufficiencies have been improved in the present invention, which provides an improved air massage device. The improved air massage device, in accordance with the present invention, presents a unique and precise pressure control of an air bag. The air massage device has at least one inflatable air bag adapted to be laid against a portion of the human body. The air massage device also utilizes an air pump for generating pressurized air. A three-way distributor valve is connected between the air pump and the air bag and is controlled to switch between an open position of feeding the pressurized air from the air pump to the air bag, and a closed position of discharging the pressurized air from the air bag to the atmosphere. A single pressure sensor is disposed upstream of the distributor valve for monitoring a pressure level developed on the downstream side of the air pump. A pressure level selector is provided for entering a desired target pressure level to which the air bag is intended to be inflated. A pressure controller controls the air pump and the distributor valve on a time period basis for inflating the air bag to the desired pressure level.

For correcting a difference between a practical pressure level of the air bag and a monitored pressure level by the pressure sensor, the pressure controller provides at least one initial inflation cycle and subsequent inflation cycles alternated by deflation cycles of deflating the air bag. The initial inflation cycle is explained below.

At first, the air pump is activated for a standard time period, which is defined as a function of the desired target pressure level, with the distributor valve in the open position. After the elapse of the standard time, the air pump is stopped, and the valve is maintained in the open position for a predetermined open time to monitor the pressure level, which is a balanced pressure level substantially equal to a pressure level of the air bag. The balanced pressure is utilized on the next subsequent inflation cycle. That is, after releasing the pressurized air from the air bag, the air pump is activated again for a varying inflation time period which is defined as a function of the target pressure level, the balanced pressure in the previous inflating cycle and a time period of activating the air pump in the previous inflating cycle. After the elapse of the inflation time, the air pump is stopped again, and the valve is maintained in the open position for a predetermined open time to monitor the pressure level, which is a balanced pressure level substantially equal to a pressure level of the air bag. The balanced pressure level is provided to determine the inflation time of the next subsequent inflation cycle. Therefore, the pressure level of the air bag will approach the desired target pressure level as the inflation cycles are repeated subsequent to the initial inflation cycle.

Accordingly, it is a primary object of the present invention to provide an improved air massage device which is capable of readily and precisely controlling a pressure level of an air bag.

In a preferred embodiment of the present invention, the inflation time period is defined to be proportional to a square root of the ratio of the target pressure level to the balanced pressure level monitored at the previous inflation time, which is a further object of the present invention.

In a preferred embodiment of the present invention, the pressure sensor is provided in a pressure line extending from the air pump to the distributor valve. A exhaust valve is also disposed in the pressure line. The exhaust valve is controlled to open for escaping the pressurized air from the pressure line to the atmosphere each time the inflation cycles are completed, thereby precisely resetting the pressure sensor to have a zero pressure level, which is still a further object of the present invention.

In a preferred embodiment of the present invention, a hazard detector is provided to acknowledge the occurrence of a hazard condition. When the monitored pressure level is higher than a maximum allowable pressure which is higher than the target pressure level by a predetermined extent, the hazard detector issues a hazard signal indicative of the hazard condition. On the other hand, when the monitored pressure level is lower than a minimum operation pressure which is lower than the target pressure level by a predetermined extend, the hazard detector issues a hazard signal indicative of this hazard condition. Therefore, the pressure controller responds to resume the initial inflation cycle repeatedly until the hazard signal is cleared. The hazard detector is useful to prevent a trouble of the massage device and an accident of the human body by over-pressurizing of the air bag.

It is, therefore, a further object of the present invention to provide an improved air massage device which is capable of safety controlling a pressure level of an air bag.

In a preferred embodiment of the present invention, a further hazard detector judges if a leakage occurs in a distributor line from the distributor valve to the air bag. When the monitored pressure level drops beyond a critical value during the open time interval, the further hazard detector issues a hazard signal indicative of the leakage. The pressure controller responds to resume the initial inflation cycle repeatedly until the hazard signal is cleared; which is a further object of the present invention.

In a preferred embodiment of the present invention, a three way source valve is disposed upstream of the pressure sensor between the air pump and the distributor valve. The source valve has an open position for feeding the pressurized air from the air pump to the distributor valve and a closed position for interrupting the communication therebetween and allowing the pressurized air to discharge to the atmosphere. The air pump is pre-activated for a limited time interval with the source valve being held in the closed position prior to being activated for feeding the pressurized air to the air bag. The time interval is useful to warm up the air pump for rapidly feeding the pressured air to the air bag.

It is, therefore, a further object of the present invention to provide an improved air massage device which is capable of rapidly providing a pressurized air to an air bag to give an effective air massage.

In a preferred embodiment of the present invention, the pressure controller limits the inflation time period with regard to at least one of a maximum time period and a minimum time period. The pressure controller also limits a ratio of the previous inflation time period to a current inflation time period. Therefore, the pressure controller prevents a wrong operation of the air pump, which is a further object of the present invention.

For an air massage device having a plurality of the air bags, a plurality of the three-way distributor valves are used, each one connecting between the air pump and a respective one of the air bags. In the initial inflation cycle, the air pump is activated for a standard time period with a first distributor valve in the open position and a second distributor valve kept in the closed position for feeding the pressurized air to a first air bag. Subsequently, the air pump is stopped, and the first distributor valve is maintained in the open position for an open time interval to monitor the pressure level.

After discharging the pressurized air with the first distributor valve in the closed position, the air pump is activated again for a standard time period with the second distributor valve in the open position and the first distributor valve in the closed position for feeding the pressurized air to a second air bag. Therefore, the pressure controller is configured to determine the standard time period individually with regard to each of the air bags, respectively.

Similarly, after performing the initial inflation cycle for each one of the air bags, the pressure controller also controls the inflation time periods individually for each of the air bags, respectively. Thus, the pressure level of each of the air bags will approach the desired target pressure level as the inflation cycles are repeated subsequent to the initial inflation cycles with respect to the air bags, respectively and alternately.

Accordingly, it is a further object of the present invention to provide an air massage device having a plurality of an air bags which is capable of readily and precisely controlling the pressure level of each of the air bags.

In a preferred embodiment of the present invention, the pressure controller operates to open, for a short time, at least one of the distributor valves in order to discharge a small amount of the pressurized air from the pressure line so as to rapidly balance the pressure level of the pressure line with that of the air bag each time the inflation time period is completed.

It is a further object of the present invention to provide an air massage device having a plurality of air bags which is capable of precisely and independently controlling the pressure level of the air bags, respectively.

In a preferred embodiment of the present invention, the pressure controller has a reset capability of the air pump. That is, when the target pressure level is changed during an operation of the air massage device, the air pump activates again for a standard time period, which is calculated based on a selected new target level, to inflate one of the air bags other than that which has been inflated immediately prior to the resetting of the target pressure level.

It is therefore a further object of the present invention to provide an improved air massage device which has a reset capability of an air pump.

In a preferred embodiment of the present invention, the pressure line includes a three-way source valve which is disposed upstream of the pressure sensor. The source valve has an open position of feeding the pressurized air from the air pump to the distributor valves and a closed position of interrupting the communication therebetween, and at the same time allowing the pressurized air to discharge to the atmosphere. The source valve is controlled to be kept in the closed position when discharging the pressurized air from the pressure line to the atmosphere to reset the pressure line. The source valve is useful to prevent a wrong operation of the pressure sensor.

It is therefore a further object to provide an improved air massage device which has a source valve which is useful to reset a pressure sensor disposed in a pressure line leading from an air pump to a three-way distributor valve.

DETAILED DESCRIPTION OF THE PREFERRED EMBODIMENTS

Figure 1:
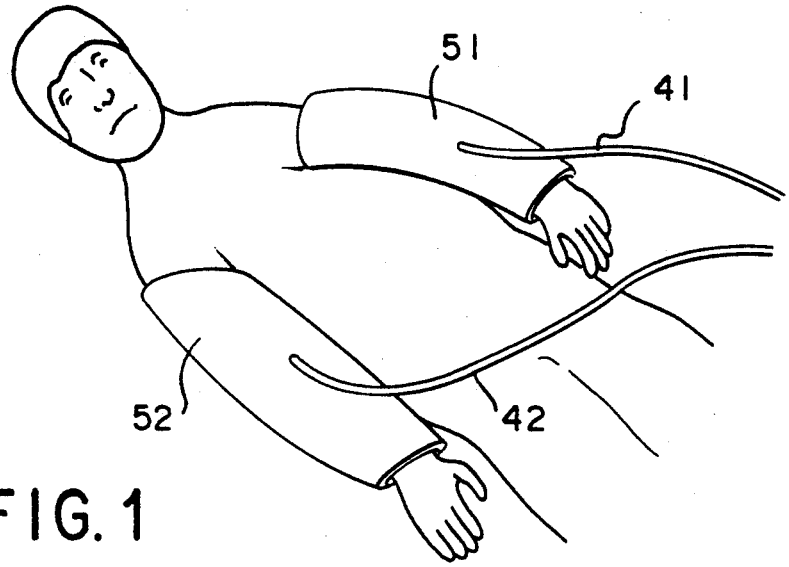
FIG. 1 is a schematic view of an air massaging device with air bags adapted to be wrapped around arms of a user.
Figure 2:
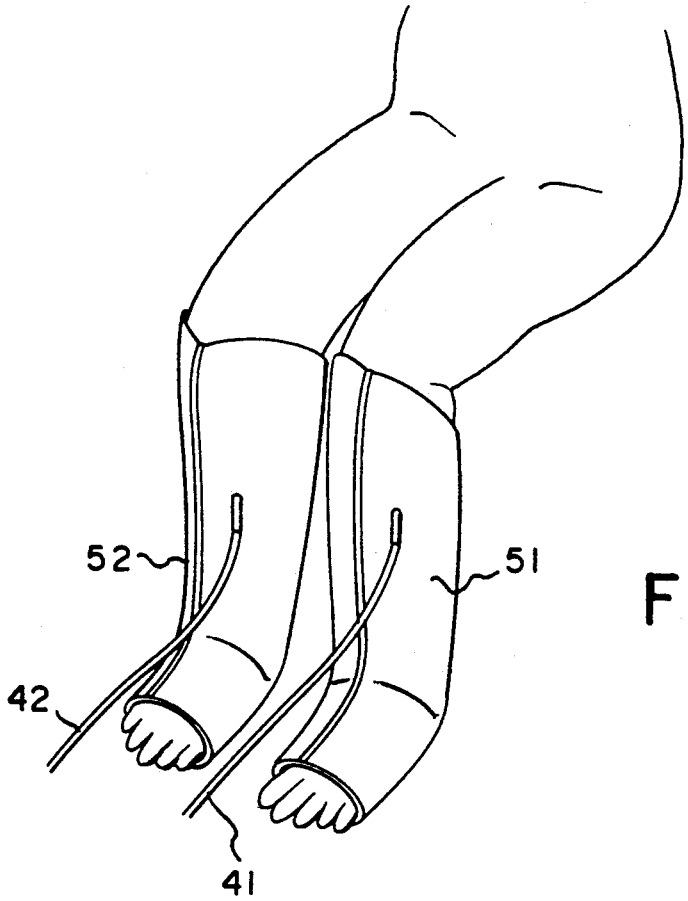
FIG. 2 is a schematic view of the air massage device with air bags adapted to be wrapped around legs of the user.
Figure 3:
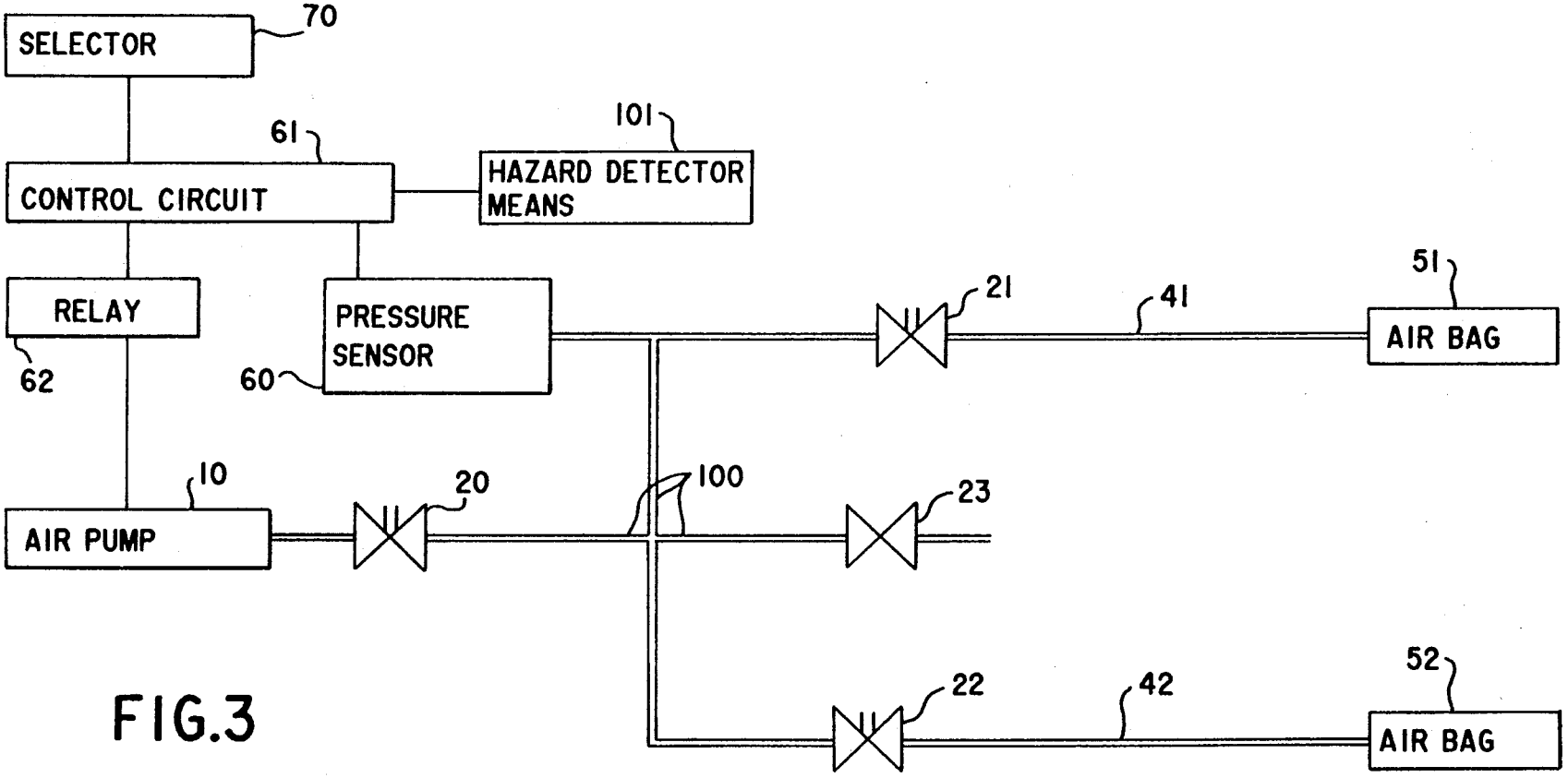
FIG. 3 is a schematic diagram of an air massage device of a first embodiment of the present invention.

A first embodiment of an air massage device of the present invention is explained below. A schematic diagram of the air massage device is shown in FIG. 3. Two inflatable air bags 51 and 52 are adapted for massaging arms or legs of the human body as shown in FIGS. 1 and 2. An air pump 10 is utilized to provide pressurized air. A three-way source valve 20 and three-way distributor valves 21 and 22 are disposed between the air pump 10 and the air bags 51 and 52. The source valve 20 connects to the air pump 10 and is disposed upstream of the distributor valves 21 and 22.

Figure 4A:
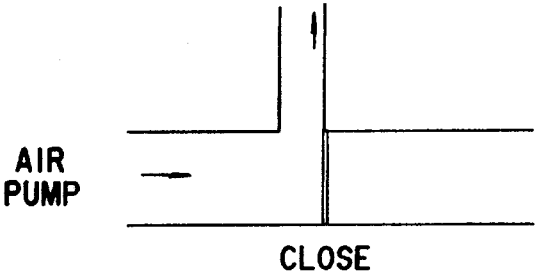
FIGS. 4A and 4B show an open position and a closed position of a three-way source valve utilized in the air massage device of the present invention.
Figure 4B:
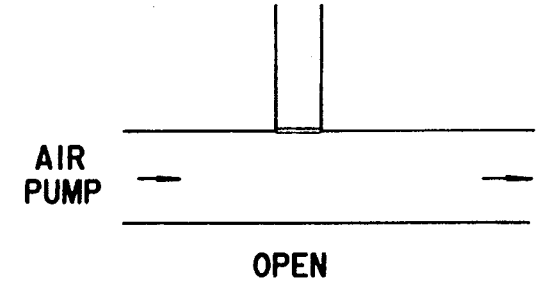

As shown in FIGS. 4A and 4B, the source valve 20 is controlled to switch between an open position for feeding the pressurized air from the air pump 10 to the air bags 51 and 52, and a closed position for discharging the pressurized air from the air pump 10 to the atmosphere while separating portions downstream and upstream of the source valve 20.

Figure 5A:
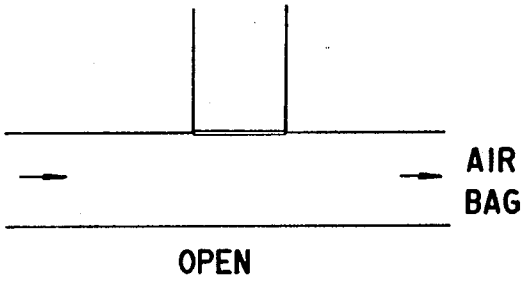
FIGS. 5A and 5B show an open position and a closed position of a three-way distributor valve utilized in the air massage device of the present invention.
Figure 5B:
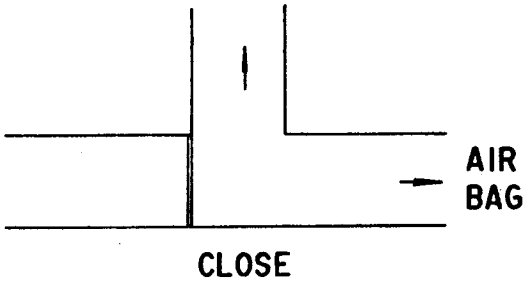

As shown in FIGS. 5A and 5B, the distributor valve 21 connects to the air bag 51 and is controlled to switch between an open position of feeding the pressurized air from the air pump 10 to the air bag 51 and a closed position of discharging the pressurized air from the air bag 51 to the atmosphere while separating portions upstream and downstream of the distributor valve 21. Similarly, the distributor valve 22 is connected to the air bag 52 and is controlled to switch between an open position and a closed position.

A single pressure sensor 60 is provided in a pressure line 100 leading from the source valve 20 to the distributor valves 21 and 22 to monitor a pressure level of the pressure line. A reset valve 23 is also disposed in the pressure line to reset the pressure sensor 60 to a pressure level of the atmosphere. A pressure selector 70 provides a desired target pressure level selected by a user. The air massage device also includes a relay 62 and a power circuit (not shown) for operating the device. A control circuit 61 controls activation of the air pump 10, selects the open position or the closed position of the source valve 20 and the distributor valves 21 and 22, and opens the reset valve 23 in order to repeat a cycle of inflating and deflating the air bags 51 and 52, respectively and alternately. That is, the control circuit 61 operates the air pump 10 on a time period basis in order to inflate the air bags 51 and 52, respectively. As discussed below, the control circuit provides at least one initial inflation cycle and subsequent inflation cycles alternated by deflation cycles of deflating the air bag.

INITIAL INFLATION CYCLE

Before the initial inflation cycle for the air bag 51, the pressure sensor 60 is reset to have a zero pressure level by opening the reset valve 23 for a short time, and the air pump 10 is pre-activated to pressurize an accumulator (not shown) of the air pump 10 while the source valve 20 is in the closed position. The preactivating of the air pump 10 is useful to rapidly inflate the air bag 51 so that it gives an effective air massage.

Then the source valve 20 is set in the open position, the distributor valve 21 is set in the open position, the distributor valve 22 is set in the closed position, and the air pump 10 is activated for a standard time period to inflate the air bag 51. The standard time period is defined by a function of the target pressure level. After the standard time period is completed, the air pump 10 is stopped, and at the same time the source valve 20 is set in the closed position.

The distributor valve 21 is maintained in the open position for a predetermined open time interval so that a pressure level of the pressure line is monitored by the pressure sensor 60 in accordance with the pressure level of the inflated air bag 51. As a difference between a practical pressure level of the air bag 51 and the monitored pressure level measured by the pressure sensor 60 is caused by a flow resistance of a hose tube 41 connecting between the pressure sensor 60 and the air bag 51, the use of this predetermined open time interval helps to balance the pressure level therebetween. A balanced pressure level is determined by calculating an average value of the monitored pressure levels for the predetermined interval.

In the first embodiment, the balanced pressure level is determined as the average value of pressure levels monitored 20 times by the pressure sensor 61. Specifically, pressure levels are monitored 22 times and maximum and minimum values are excluded. The balanced pressure level is provided in the following subsequent inflation cycles. After the predetermined interval is completed, the pressurized air is discharged from the air bag 51 to the atmosphere with the closed position of the distributor valve 21 so that the air bag 51 is deflated.

A similar initial inflation cycle is repeated to inflate the air bag 52.

Subsequent Inflation Cycle

Before the subsequent inflation cycles, the pressure sensor 60 is reset by opening the reset valve 23 for a short time, and the air pump 10 is preactivated to pressurize the accumulator of the air pump 10. Then the source valve 20 is set in the open position, the valve 21 is set in the open position, the valve 22 is set in the closed position, and the air pump is activated for a varying inflation time period to inflate the air bag 51.

Figure 6:
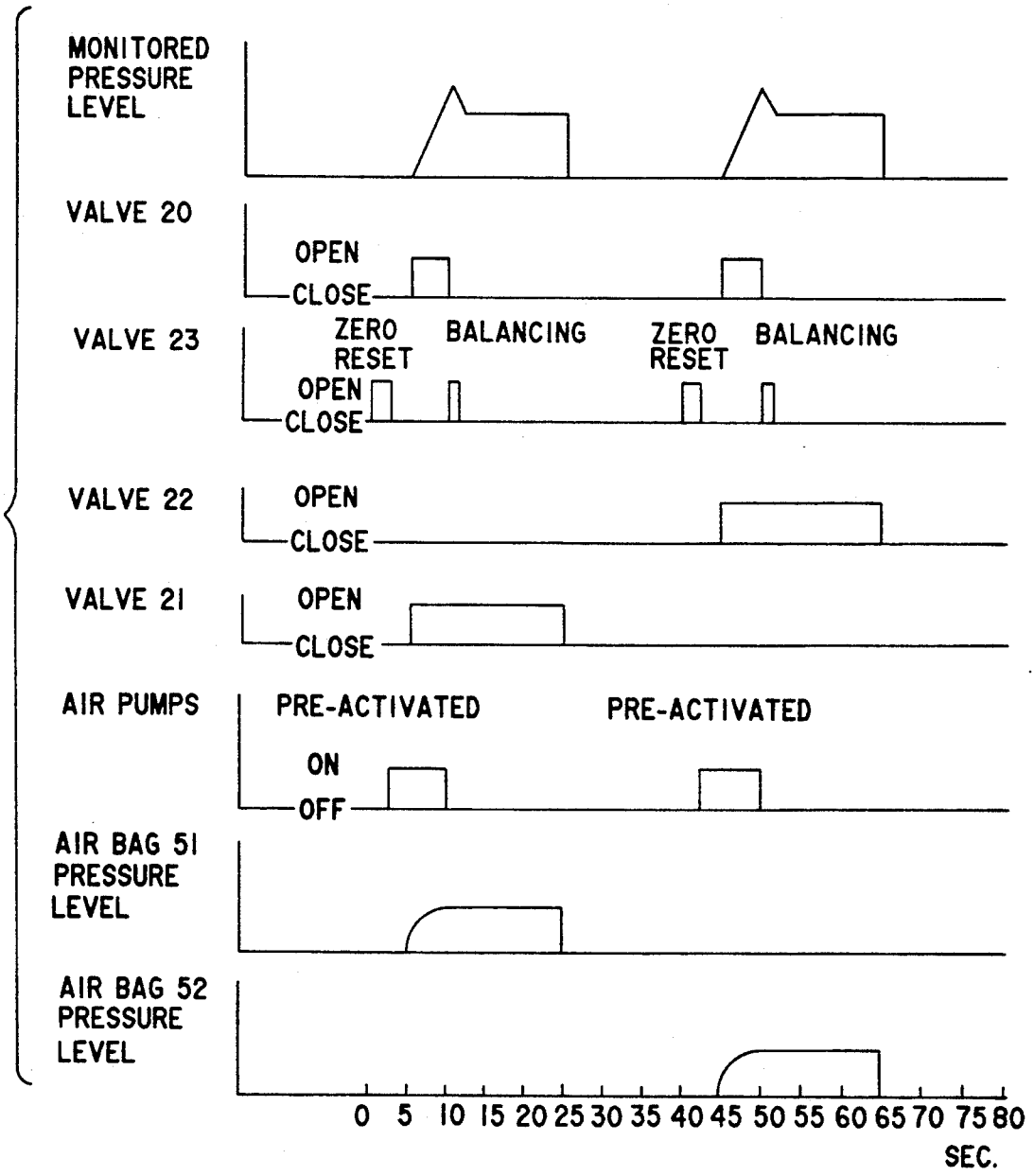
FIG. 6 is a schematic time chart of the air massage device of the first embodiment of the present invention illustrating: (1) pressure level monitored by a pressure sensor, (2) operation of the source valve 20, (3) operation of the distributor valves 21 and 22, (4) operation of the reset valve 23, (5) activation of an air pump, and (6) expected pressure levels of the air bags.

A schematic time chart of the air massage device with respect to the air bags 51 and 52 is shown in FIG. 6. The inflation time period is defined by a function of (1) a time period of actuating the air pump 10 in the previous inflation cycle, which is equal to the standard time period in case of the first time of the subsequent inflation cycles, (2) the target pressure level and (3) the balanced pressure level determined during the previous inflation cycle. In the first embodiment of the present invention, the inflation time period (T) is provided by the following equation;

$$T = T_1\sqrt{\frac{PS}{Pl}}$$

wherein $T_1$ is the time period of actuating the air pump 10 in the previous inflation cycle, PS is the target pressure level and Pl is the balanced pressure level in the previous inflation cycle. After the inflation time period is completed, the air pump 10 is stopped, and at the same time the source valve 20 is set in the closed position. The distributor valve 21 is maintained with the open position for the predetermined open time interval so that the pressure level of the pressure line is monitored by the pressure sensor 60 in accordance with the pressure level of the inflated air bag 51.

The balanced pressure level is determined in the same manner as in the initial inflation cycle. This balanced pressure level will be used in the next subsequent inflation cycle with respect to the air bag 51. After the predetermined interval is completed, the pressurized air is discharged from the air bag 51 to the atmosphere with the closed position of the distributor valve 21.

A similar subsequent inflation cycle is repeated to inflate the air bag 52. Therefore, the pressure level of the air bags 51 and 52 will both approach the intended target pressure level as the inflation cycles are repeated subsequent to the initial inflation cycles with respect to the air bags 51 and 52, respectively and alternately.

In the first embodiment, the pressure sensor 60 is reset each time before providing the pressurized air to the air bag 51 and 52. Therefore, the control circuit 61 can control independently the air bags 51 and 52, respectively, so that a safe and effective air massage is given irrespective of different sizes of arms or legs. In addition, the reset valve 23 is opened for a short time, i.e., 0.3 to 0.5 seconds, to discharge a small amount of the pressurized air from the pressure line to the atmosphere, thereby the balanced pressure level can be rapidly determined.

In the first embodiment, the control circuit can also prevent a wrong operation of the air massage device. For example, when the inflated air bag 51 is over-pressurized during an operation of the air massage device, the pressure sensor 60 monitors an unexpected high pressure level, so that the air pump 10 activates for a wrong inflation time period calculated by the equation (1) on the next inflation cycle of the air bag 51. To prevent a wrong operation of the air massage device, the control circuit 61 limits the inflation time period with regard to at least one of a maximum time period and a minimum time period, (i.e., a maximum period of 8 seconds and a minimum period of 3 seconds).

The control circuit 61 also limits a ratio of the previous inflation time period to a current inflation time period, i.e., by 50%.

In addition, in the first embodiment, the air massage device includes an hazard detector means 101, shown in FIG. 3, which has the following safety functions. When the balanced pressure level is monitored as a pressure level lower than a minimum allowable pressure level, i.e., if the hose tube 41 is disconnected between the distributor valve 21 and the air bag 51, an hazard lamp turns on and an hazard buzzer sounds in response to this unusual case. The hazard lamp and hazard buzzer being a part of the hazard detector means 101 illustrated in FIG. 3.

Similarly, when the balanced pressure level is monitored as a pressure level higher than a maximum allowable pressure level, i.e. if the hose tube is choked, the hazard lamp turns on and the hazard buzzer sounds in response to this unusual case.

In addition, when the balanced pressure level is out of a range of the target pressure level +15 mm Hg, it is determined to denote an unusual case.

Furthermore, when measuring the balanced pressure level, if the pressurized air leaks during the predetermined time period so that a ratio of a pressure level monitored at the first time of the predetermined period to a pressure level monitored at the last time of the predetermined period is greater than a certain ratio, i.e. 50%, the hazard lamp turns on and the hazard buzzer sounds in response to this unusual case.

The control circuit 61 will provide the standard inflation time period in the next inflation time until the unusual cases are cleared.

In addition, in the first embodiment, when the target pressure level is changed during the inflation time period of a first of the air bags, i.e. the air bag 51, the other air bag, i.e. air bag 52, is inflated in the next inflation cycle for a standard time which is determined based on the selected new target pressure level. This will help to prevent a wrong operation in the air bag 51. On the other hand, when the target pressure level is changed during a time period of inflation of another air bag, i.e. air bag 52, the air bag 51 will be inflated for the standard time in the next inflation cycle.

In the first embodiment, it is preferred that the air pump 10 is preactivated each time before the inflation cycle, with the open position of the source valve 20 and the closed position of the distributor valves 21 and 22. When the monitored pressure level in the pressure line 100 increases beyond a predetermined critical pressure level during the preactivation of the air pump 10, the control circuit 61 operates to open the reset valve 23, so that the pressurized air is discharged from the pressure line to the atmosphere.

Figure 7:
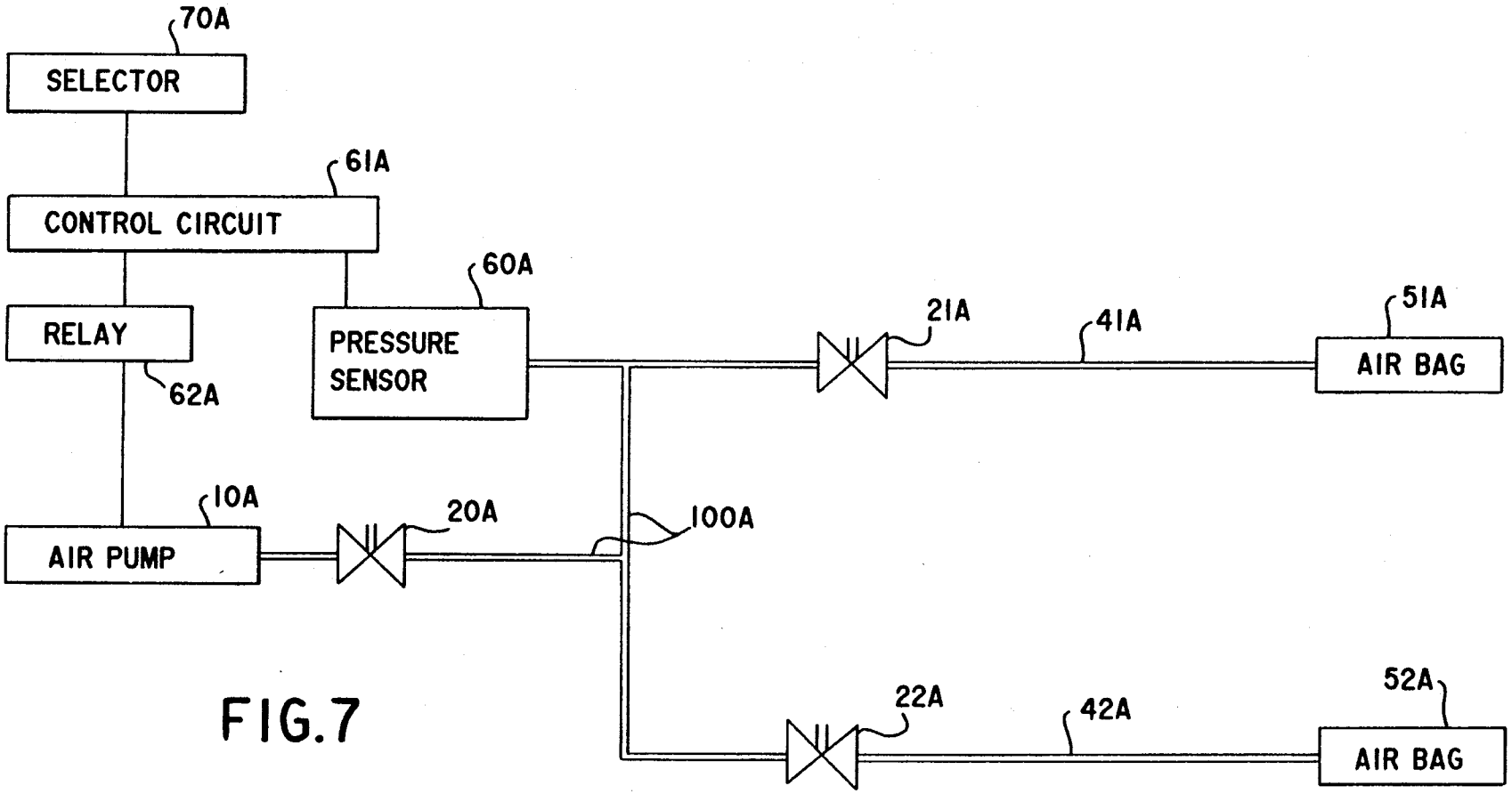
FIG. 7 is a schematic diagram of an air massage device of a second embodiment of the present invention.
Figure 8:
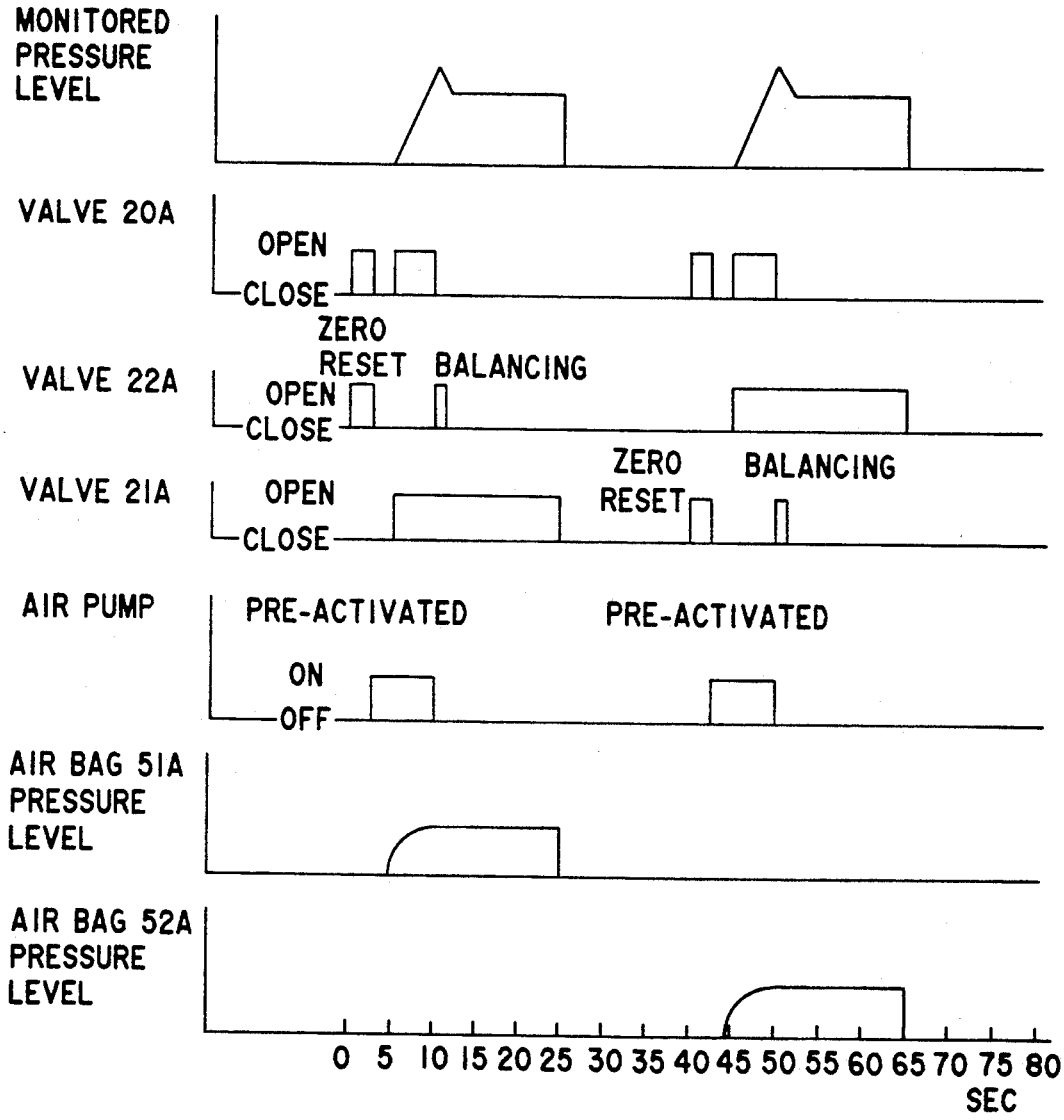
FIG. 8 is a schematic time chart of the air massage device of the second embodiment of the present invention illustrating: (1) pressure level monitored by a pressure sensor, (2) operation of the source valve, (3) operation of the distributor valves, (4) activation of an air pump, and (5) expected pressure levels of the air bags.

A second embodiment of the present invention is shown in FIG. 7, which is identical in structure to the first embodiment except that the reset valve 23 is removed from the air massage device of FIG. 3. Therefore no duplicate explanation to common parts and operation is deemed necessary. Like parts are designed by like numerals with a suffixed letter of "A". A schematic time chart of an air massage device of the second embodiment is also shown in FIG. 8.

A control circuit 61A performs the following step for rapidly determining the balanced pressure level. After the inflation time period of the air bag 51A is completed, the distributor valve 22A is set in the open position for a short time to discharge a small amount of the pressurized air in the pressure line 100A to the air bag 52A, and at the same time the distributor valve 21A is maintained in the open position for the predetermined open time interval to communicate with the inflated air bag 51A, thereby rapidly determining the balanced pressure level of the air bag 51A.

In addition, before providing the pressurized air to the air bag 51A, the pressure sensor 60A is reset by selecting the open position of the distributor valve 22A connected the other air bag 52A.

Therefore, the air massage device has a simpler structure compared with that of the first embodiment.

What is claimed is:

1. An air massing device, comprising:

at least one inflatable air bag adapted to be laid against a portion of the human body;

air pump means for generating a pressurized air;

three-way distributor valve means connected between said air pump means and said air bag for providing an open position of feeding the pressurized air from said air pump means to a first of said at least one air bag and a closed position of allowing the pressurized air to be discharged from said first air bag to the atmosphere, in order to repeat inflating and deflating said first air bag;

a single pressure sensor disposed upstream of said three-way distributor valve means to monitor a pressure level developed on a downstream side of said air pump means;

selector means for entering a desired target pressure level to which said first air bag is intended to be inflated; and a control means which includes (a) for at least one initial inflation cycle, (1) means for activating said air pump means for a predetermined standard time period with said valve means in said open position for feeding the pressurized air to said first air bag, (2) means for maintaining said distributor valve means in said open position for a predetermined first open time interval after the elapse of said standard time period so as to keep said first air bag inflated, and (3) means for reading a first pressure level monitored by said pressure sensor within said first open time interval, and (b) for at least one subsequent inflation cycle, (1) means for activating said air pump means for a varying inflation time period which is defined as a function of (a) the time period of activating said air pump means in the immediately previous inflation cycle, (b) said target pressure level, and (c) the pressure level read during the immediately previous inflation cycle;

(2) means for maintaining said distributor valve means in said open position for a predetermined second open time interval after the elapse of said varying inflation time period so as to keep said first air bag inflated; and (3) means for reading a second pressure level monitored by said pressure sensor within said second open time interval.

2. A air massaging device as set forth in claim 1, wherein said varying inflation time period is defined to be in proportion to a square root of the ratio of said target pressure level to the pressure level read during the immediately previous inflation cycle.

3. An air massaging device as set forth in claim 1, wherein said pressure sensor is provided in a pressure line extending from said air pump means to said distributor valve means, said pressure line including an exhaust means, which is controlled by said control means, for escaping the pressurized air from said pressure line each time either said initial inflation cycle or said subsequent inflation cycle is completed, thereby resetting said pressure sensor means to have a zero pressure level, said exhaust means including an exhaust valve.

4. An air massaging device as set forth in claim 1, including hazard detector means for (a) acknowledging the occurrence of a hazard condition when either of said first or second pressure level monitored by said pressure sensor is higher than a maximum allowable pressure which is higher than said target pressure level by a predetermined extent, (b) issuing a hazard signal indicative of said hazard condition, and (c) resuming said initial inflation cycle until said hazard signal is cleared.

5. An air massaging device as set forth in claim 1, including hazard detector means for (a) acknowledging the occurrence of a hazard condition when either of said first or second pressure level monitored by said pressure sensor is lower than a minimum operation pressure which is lower than said target pressure level by a predetermined extent, (b) issuing a hazard signal indicative of said hazard condition, and (c) resuming said initial inflation cycle repeatedly until said hazard signal is cleared.

6. An air massaging device as set forth in claim 1, including hazard detector means for (a) judging that a leakage occurs in a distributor line from said distributor valve means to said first air bag, (b) issuing a hazard signal indicative of said leakage when either of said first or second pressure level monitored by said pressure sensor is beyond a critical value during either said first or second open time interval, respectively, and (c) resuming said initial inflation cycle repeatedly until said hazard signal is cleared.

7. An air massaging device as set forth in claim 1, wherein said control means also has means for pre-activating said air pump means for a limited time interval prior to being activated for feeding the pressurized air to said air bag.

8. An air massaging device as set forth in claim 1, including a three-way source valve disposed upstream of said pressure sensor between said air pump means and said distributor valve means, said source valve having an open position of feeding the pressurized air from said air pump means to said distributor valve means and a closed position of interrupting the communication therebetween and allowing the pressurized air to discharge to the atmosphere, said control means also having means for pre-activating said air pump means for a limited time interval with said source valve being held in said closed position prior to being activated for feeding the pressurized air to said air bag.

9. An Air massaging device as set forth in claim 1, wherein said control means also has means for limiting said inflation time period with regard to at least one of a maximum time period, a minimum time period, and a ratio of the previous inflation time period to a current inflation time.

10. An Air massaging device, comprising:

a plurality of inflatable air bags adapted to be laid against a portion of the human body;

air pump means for generating a pressurized air;

a plurality of three-way distributor valves each connected between said air pump means and a respective one of said individual air bags, each of said distributor valves being constructed to switch between an open position of feeding the pressurized air from said air pump means to the respective air bag and a closed position of allowing the pressurized air to be discharged from the respective air bag to the atmosphere, in order to repeat inflation and deflation of the respective air bag;

a single pressure sensor disposed upstream of said distributor valves to monitor a pressure level developed on a downstream side of said air pump means;

selector means for entering a desired target pressure level to which said air bags are intended to be inflated; and control means which includes:

(a) for at least one initial inflating cycle, (1) means for activating said air pump means for a predetermined standard time period with a first of said distributor valves in the open position and the other of said distributor valves kept in the closed position for feeding the pressurized air to the air bag respective to said first of said distributor valves, (2) means for maintaining the first of said distributor valves in said open position for a predetermined first open time interval after the elapse of said standard time period so as to keep the respective air bag inflated; and (3) means for reading a first pressure level monitored by said pressure sensor within said first open time interval; and (b) for at least one subsequent inflating cycle, (1) means for activating said air pump means for a varying inflation time period which is defined as a function of (a) the time period for activating said air pump means in the immediately previous inflating cycle, (b) said target pressure level, and (c) the pressure level read during the immediately previous inflating cycle;

(2) means for maintaining said first distributor valve in said open position for a second predetermined open time interval after the elapse of said varying inflation time period so as to keep the respective air bag inflated; and (3) means for reading a second pressure level monitored by said pressure sensor within said second open time interval.

11. An air massaging device as set forth in claim 10, wherein said control means is capable of determining inflation time periods individually with regard to each of said air bags.

12. An air massaging device as set forth in claim 10, wherein said control means has a respect capability of initializing said air pump means to activate for said standard time period each time a resetting is made to alter said target pressure level during the operation of said device, and said control means acting upon said resetting to inflate one of the air bags other than the air bag which has been inflated immediately prior to the resetting of the target pressure level.

13. An air massage device as set forth in claim 10, wherein said pressure sensor is provided in a pressure line extending from said air pump means to said distributor valves and said control means having means which acts to open at least one of said distributor valves other than the first of said distributor valves for a short time period after said varying inflation time period has elapsed, thereby escaping the pressurized air from said pressure line for said short time period when the varying inflation time period has elapsed in order to expedite balancing of the pressure level in said pressure line with that of the respective air bag.

14. An air massaging device as set forth in claim 13, wherein said pressure line includes a three-way source valve which is disposed upstream of said pressure sensor between said air pump means and said distributor valves, said source valve having an open position of feeding the pressurized air from said air pump means to said distributor valves and a closed position of interrupting the communication therebetween and allowing the pressurized air to discharge to the atmosphere, said source valve being controlled to be kept in the closed position when escaping the pressurized air from said pressure line for effecting a resetting of said pressure sensor.

15. A method of massaging a human body, comprising the steps of:

(1) providing a plurality of inflatable air bags adapted to be laid against a portion of the human body;

(2) providing air pump means for generating a pressurized air;

(3) providing a plurality of three-way distributor valves each connected between said air pump means and a respective one of said individual air bags, each of said distributor valves being constructed to switch between an open position of feeding the pressurized air from said air pump means to the respective air bag and a closed position for allowing the pressurized air to be discharged from the respective air bag to the atmosphere, in order to repeat inflation and deflation of the respective air bag;

(4) providing a single pressure sensor disposed upstream of said distributor valves to monitor a pressure level developed on a downstream side of said air pump means;

(5) providing selector means for entering a desired target pressure level to which said air bag is intended to be inflated;

(6) inflating a first of the air bags in an initial inflating cycle by:

(a) activating said air pump means for a predetermined standard time period with the respective distributor valve in the open position and the other of the distributor valves kept in the closed position for feeding the pressurized air to the first of the air bags, (b) maintaining the respective distributor valve in the open position for a predetermined first open time interval after the elapse of the standard time period so as to keep the first of the air bags inflated; and (c) reading the pressure level monitored by the pressure sensor within the first open time interval;

(7) inflating the first of the air bags in a subsequent inflating cycle by:

(a) activating the air pump means for a varying inflation time period which is defined as a function of (a) the time period of activating the air pump means in the immediately previous inflating cycle, (b) the target pressure level, and (c) the pressure level read during the immediately previous inflating cycle;

(b) maintaining the respective distributor valve in the open position for a second predetermined open time interval after the elapse of the varying inflation time period so as to keep the first of the air bags inflated; and (c) reading a second pressure level monitored by the pressure sensor within the second open time interval.

16. The method as set forth in claim 15, further including the steps of determining inflation time period individually with regard to each of the other air bags.

17. The method as set forth in claim 15, further including the steps of initializing said air pump means to activate for said standard time period each time a resetting is made to alter said target pressure level during the operation of said device, and acting upon said resetting to inflate one of the air bags other than an air bag which has been inflated immediately prior to the resetting of the target pressure level.

18. The method as set forth in claim 15, wherein the step of providing a single pressure sensor further includes providing the pressure sensor in a pressure line extending from said air pump means to said distributor valves, and further including the step of opening at least one of said distributor valves other than the respective distributor valve for a short time period after said varying inflation time period has elapsed.

19. The method as set forth in claim 18, further including the steps of (1) providing a three-way source valve in the pressure line which is disposed upstream of said pressure sensor between said air pump means and said distributor valves, wherein the source valve has an open position of feeding the pressurized air from said air pump means to said distributor valve means and a closed position of interrupting the communication therebetween and allowing the pressurized air to discharge to the atmosphere and (2) controlling the source valve to be kept in the closed position during an escaping of the pressurized air from said pressure line for effecting a resetting of said pressure sensor.

20. The method as set forth in claim 15, wherein said varying inflation time period is defined to be in proportion to a square root of the ratio of said target pressure level to said pressure level monitored during the previous inflation cycle.

21. The method as set forth in claim 15, wherein the step of providing a single pressure sensor further includes providing the pressure sensor in a pressure line extending from said air pump means to said distributor valve means, and further comprising the step of providing the pressure line with an exhaust valve and controlling the exhaust valve to open for escaping the pressurized air from said pressure line when said initial or subsequent inflation cycle is completed, thereby resetting said pressure sensor means to have a zero pressure level.

22. The method as set forth in claim 15, further including the steps of (1) detecting a hazard occurrence on a hazard condition when either of said first or second pressure level monitored by said pressure sensor is higher than a maximum allowable pressure which is higher than said target pressure level by a predetermined extent and issuing a hazard signal indicative of said hazard condition and (2) responding to resume said initial inflation cycle repeatedly until said hazard signal is cleared.

23. The method as set forth in claim 15, further including the steps of (1) detecting a hazard occurrence of a hazard condition when either of said first or second pressure level monitored by said pressure sensor is lower than a minimum operation pressure which is lower than said target pressure level by a predetermined extent and issuing a hazard signal indicative of said hazard condition and (2) responding to resume said initial inflation cycle repeatedly until said hazard signal is cleared.

24. The method as set forth in claim 15, further including the steps of (1) detecting if a leakage occurs in a distributor line from said distributor valves to said air bags and issuing a hazard signal indicative of said leakage when either of said first or second pressure level monitored by said pressure sensor is beyond a critical value during either said first or second open time interval and (2) in response to said hazard signal, operating to resume said initial inflation cycle repeatedly until said hazard signal is cleared.

25. The method as set forth in claim 15, further including the step of pre-activating the air pump means for a limited time interval prior to activating the air pump means for feeding pressurized air to said first air bag.

26. The method as set forth in claim 15, including the steps of (1) providing a three-way source valve disposed upstream of said pressure sensor between said air pump means and said distributor valves, said source valve having an open position of feeding the pressurized air from said air pump means to said distributor valve means and a closed position of interrupting the communication therebetween and allowing the pressurized air to discharge to the atmosphere and (2) pre-activating said air pump means for a limited time interval with said source valve being held in said closed position prior to being activated for feeding the pressurized air to said first air bag.

27. The method as set forth in claim 15, further including the step of limiting said varying inflation time period with regard to at least one of a maximum time period, a minimum time period, and a ratio of the previous inflation time period to a current inflation time.

* * * * *